United States Patent [19]

Lattmann et al.

[11] 4,176,988

[45] Dec. 4, 1979

[54] APPARATUS FOR SEPARATING OPENED FIBRE FLOCKS FROM A TRANSPORTING AIR STREAM

[75] Inventors: Werner Lattmann, Winterthur; Paul Stäheli, Wilen b. Wil, both of Switzerland

[73] Assignee: Rieter Machine Works Ltd., Winterthur, Switzerland

[21] Appl. No.: 922,815

[22] Filed: Jul. 10, 1978

[30] Foreign Application Priority Data

Jul. 18, 1977 [CH] Switzerland ..... 8849/77

[51] Int. Cl.[2] ..... B65G 53/60

[52] U.S. Cl. ..... 406/171; 19/105

[58] Field of Search ..... 302/28, 59; 19/105, 19/205; 55/428

[56] References Cited

U.S. PATENT DOCUMENTS

| | | | |
|---|---|---|---|
| 3,400,518 | 9/1968 | Staheli | 406/171 X |
| 3,487,509 | 1/1970 | Bond | 19/105 X |

*Primary Examiner*—James L. Rowland

*Attorney, Agent, or Firm*—Werner W. Kleeman

[57] ABSTRACT

An apparatus for separating opened fibre flocks from a transporting air stream composed of one chute or of a plurality of consecutive chutes connected to a transporting duct. At least one air permeable separating wall guides transporting air into an exhaust duct located behind the separating wall. A driven take-off device which forms a fibre layer is arranged at the lower chute end. The take-off device comprises a take-off roll which is arranged facing the air permeable separating wall and leaving free a small cross-section, as the deposited fibres pass through. The exhaust duct extends at least into the zone of the smallest clearance between the take-off roll and the wall, and, the take-off roll is sealed with respect to the other wall.

6 Claims, 3 Drawing Figures

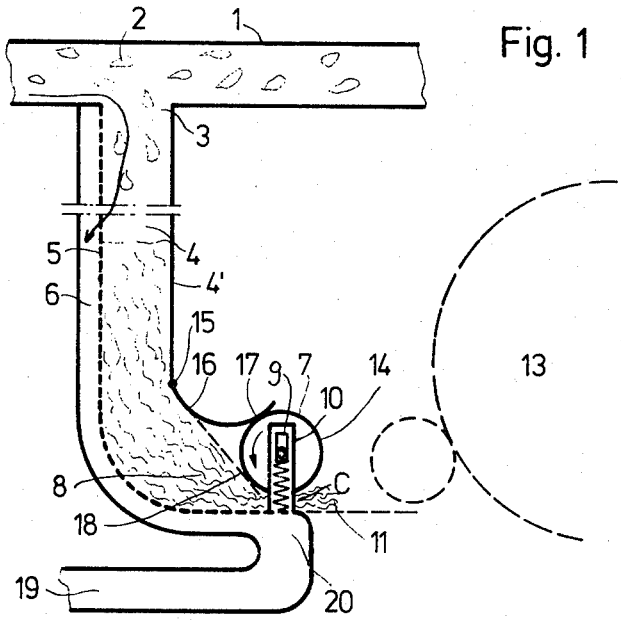
Fig. 1
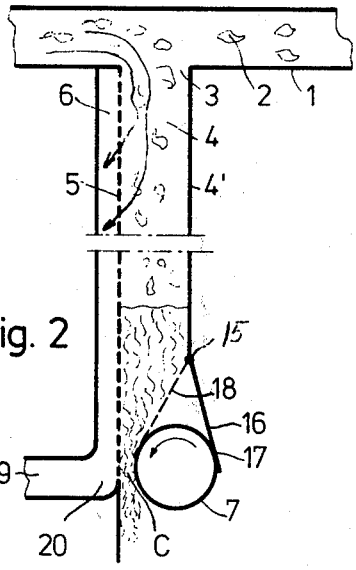
Fig. 2
Fig. 3
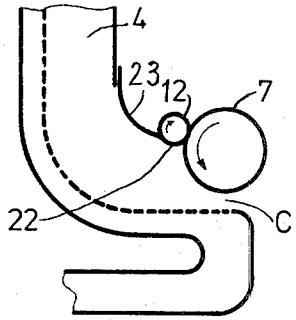

APPARATUS FOR SEPARATING OPENED FIBRE FLOCKS FROM A TRANSPORTING AIR STREAM

BACKGROUND OF THE INVENTION

The present invention concerns a new and improved apparatus for separating opened fibre flocks from a transporting air stream which is of the type comprising one feed chute or a plurality of consecutive feed chutes, connected to a transporting duct, with at least one air-permeable separating wall for guiding transporting air into an exhaust duct located behind the separating wall, and a driven take-off device forming a fibre layer arranged at the lower chute end.

In German Patent No. 1,286,436 and the corresponding U.S. Pat. No. 3,400,518 there is disclosed a fibre depositing chute which is connected to a fibre transporting duct. The transporting air is separated from the fibre material by means of slots provided in one of the chute walls and is guided into an area or room where there prevails a lower pressure. At the lower chute end two take-off rolls compress the flock column formed in the chute and take it off in the form of a fibre layer, or transfer the fibre layer to a subsequent processing stage, as the case may be.

In the prior art device one of the take-off rolls is designed as a perforated drum for improving the taking-in of the flock column into the clamping nip of the pair of rolls or for rendering this process disturbance-free, respectively.

It now has been found that, the taking-in of the flock column into the nip of the pair of take-off rolls does not function satisfactorily and that in this known device, if operated at sub-atmospheric pressure, sealing problems arise between the take-off rolls and the chute. A further disadvantage resides in the fact that, particularly if a perforated drum is used as a take-off roll, the sealing problems which arise only can be overcome with excessive efforts, rendering the device disproportionately expensive.

SUMMARY OF THE INVENTION

Hence it is a primary object of the present invention to devise an apparatus for separating fibre flocks from a transporting air stream which, compared to traditional devices, is of simpler design and in operation is economically more feasible, consists of fewer movable parts and produces a fibre layer which is as uniform as possible, independently of whether the apparatus is operated at above-atmospheric or at below-atmospheric pressures.

A further important object is to achieve a correct and automatic taking-in action independent of the location of the arrangement.

Now in order to implement these and still further objects of the invention, which will become more readily apparent as the description proceeds, the apparatus of the present development is manifested by the features that the take-off device comprises one take-off roll arranged facing the air-permeable separating wall in a manner such that there remains a small clearance as the deposited fibres pass through. Further, the exhaust duct extends into the zone of the smallest clearance of the take-off roll from the wall, and the take-off roll is sealed with respect to the other wall.

BRIEF DESCRIPTION OF THE DRAWINGS

The invention will be better understood and objects other than those set forth above, will become apparent when consideration is given to the following detailed description thereof. Such description makes reference to the annexed drawings wherein:

FIG. 1 is a schematic cross-section view of a fibre depositing chute with a horizontal take-off arrangement and constructed according to the teachings of the present invention;

FIG. 2 is a cross-sectional view of a fibre depositing chute with a vertical take-off arrangement and constructed according to the teachings of the present invention; and FIG. 3 is a fragmentary detail showing of a chute sealing arrangement.

DETAILED DESCRIPTION OF THE PREFERRED EMBODIMENTS

Describing now the drawings, it is to be understood that only enough of the textile machine has been shown in order to enable those skilled in the art to readily understand the underlying principles and teachings of the present invention. Turning attention now to the embodiment of FIG. 1, it will be understood that an air-carrying or transport duct or conduit 1 brings fibre flocks 2, which are supplied, for instance by a bale plucker, by a bale breaker or a cleaning machine in the blow-room, to the upper end 3 of a fibre-depositing chute 4, frequently also referred to as a feed-chute. This fibre-depositing or feed-chute 4 has a separating wall 5 which is air-permeable. A separating wall 5 of the feed-chute 4 separates such chute 4 from the adjacent exhaust duct 6.

The exhaust duct 6 and the separating wall 5 extend to the region of a driven take-off roll 7, where they are directed tangentially. This driven take-off roll 7 is provided at the lower chute end 8. The take-off roll 7 is movably supported in a guide device 9 and is pressed by a spring 10 or an equivalent device against the removed fibre layer 11. The surface of the take-off roll 7 can be smooth or can be structured.

A take-off roll 7 can be dispensed with if the chute 4 is operatively associated with a card 13 and if the chute end 8 and the exhaust duct 6, respectively, terminate in the zone of the feed roll 14 of the card 13 (the card being indicated with dash-dotted lines in FIG. 1, and the feed roll 14 coinciding with the take-off roll 7). In this case the feed roll 14 of the card fulfills the task of the take-off roll 7.

As it is up to the user to operate the chute 4 at above-atmospheric pressure or at below-atmospheric pressure, various design alternatives of the sealing device between the front chute wall 4' and the movably arranged take-off roll 7 are shown. For operation at below-atmospheric pressure a sheet metal plate 16 is linked to a pivoting axis or shaft 15 provided at the chute wall 4' and extending essentially parallel to the take-off roll 7. The pivotable plate 16 contacts the take-off roll 7 under its own weight and forms a linear seal 17.

In FIG. 3 another design of the sealing device is shown. A sheet metal extension plate 23 is rigidly connected to the chute wall 4' and extends into the close vicinity of the take-off roll 7, forming a clearance 22. In the clearance 22 between the plate 23 and the take-off roll 7 there is arranged a cylindrical sealing roll 12 which also rotates since it is frictionally driven by the take-off roll 7. As the below atmospheric pressure in the chute 4 increases, the contacting pressure of the plate 16 or the sealing roll 12, respectively, exerted upon the take-off roll 7 also increases. For operation at above-atmospheric pressure a plate 18 (shown with broken lines in FIG. 2) is linked to a pivoting axis or shaft 15 in such a manner that it likewise contacts the take-off roll 7 at the side facing the chute. The contacting pressure increases as the above-atmospheric pressure in the chute 4 increases, and, thus, ensures for reliable sealing action at all times.

The described sealing devices function reliably and independently of the position of the take-off roll 7, which position changes as a function of the thickness of the fibre layer 11. Without these sealing devices functioning reliably at all times, taking-in the fibre layer could not be achieved, or only with great difficulties, when the system is operated at below-atmospheric pressure.

The exhaust duct 6 is of the same cross-section over the whole length within the chute 4, which can be enlarged in the zone or region upstream of the take-off roll 7, just before merging into an exhaust duct 19 which is connected with any suitable vacuum source (not shown).

It is important that the separating wall 5 protrude into a clamping nip zone designated by reference character C. The clamping nip zone C is the section line of a plane containing the rotating axis of the take-off roll 7 and extending at right angles to the separating wall 5.

The relations of the dimensions of the exhaust duct advantageously are chosen as follows: The exhaust duct 6, at 1 meter width (width of the card), is of a depth of about 15 to 30 mm, and the fibre depositing chute 4 is of a depth of about 90 to 120 mm, the air throughput being about 0.4 $m^3$/sec.

The air permeable separating wall 5 can be made of perforated sheet metal, in which case care should be taken that the perforations are free of sharp edges and burrs on which fibres can be caught, and thus, can cause blockage of the perforations and which would cause increased friction of the flock column in the chute.

The separating wall 5 also can be made from a textile fabric of suitable air permeability, which can perform the same function as a perforated sheet metal plate if extended or spanned on a rigid, grid-like frame.

It also is possible to provide the separating wall with narrow slots extending over its entire length from the top to the bottom.

The mode of operation of the described apparatus consists in that the flock-carrying air stream is guided into the chute 4. Under the influence of the pressure drop between the chute 4 and the exhaust duct 6 the air flows through the perforated separating wall 5 into the exhaust duct 6. The fibre flocks 2 which are carried on are retained in the chute 4, deposited and condensed. The compact fibre layer produced in this manner is pressed towards the take-off roll 7, where it is further compressed into a fibre layer, is taken-off and is transferred to a subsequent processing stage.

The advantages of the present invention reside in that the flock column at the end of the exhaust duct in the clamping nip zone C is pressed into the clearance between the take-off roll 7 and the separating wall 5 in such a manner that a diminuation of the cross-section is effected, affording disturbance-free and automatic taking-in of the flock column in this clamping nip zone C at above-atmospheric pressure as well as at below-atmospheric pressure.

The use of an expensive perforated drum can be dispensed with and the take-off device merely consists of one single driven roll.

The pivotable sealing plates permit excellent accessability to the take-off roll.

If operated at below-atmospheric pressure, all feed chutes can be connected to a common, central suction device. Thus, there is possible the use of a highly efficient, high performance fan.

If the apparatus is applied to cards, of course also the card fan can be used as a vacuum source.

With the inventive apparatus it is furthermore irrelevant whether the duct or chute 6 is curved at its lower end (as shown in FIG. 1) and the fibre layer emerges into a horizontal plane, or whether the fibre layer emerges vertically down at the lower end (as shown in FIG. 2). Furthermore, it is also possible to operate the described chute also in any desired position with respect to the room, thus, e.g. the chute can be placed "upside down", in which arrangement the fibre deposition and the taking-off of the fibre layer are effected in the upper part, and the fibre flocks are fed upwards from below.

The described apparatus also is suitable for forming a fibre layer from waste fibres.

While there are shown and described present preferred embodiments of the invention, it is to be distinctly understood that the invention is not limited thereto, but may be otherwise variously embodied and practiced within the scope of the following claims. Accordingly,

What is claimed is:

1. An apparatus for separating opened fibre flocks from a transporting air-stream, moving through a transporting duct, comprising:
   - at least one chute operatively connected with the transporting duct;
   - an exhaust duct cooperating with said chute;
   - said chute being provided with at least one air-permeable separating wall for guiding transporting air into said exhaust duct;
   - said chute having a lower end region;
   - a driven take-off device arranged at said lower end region of said chute comprising a take-off roll arranged facing said air-permeable separating wall and leaving free a small cross-section through which pass the deposited fibres;
   - said take-off device forming a fibre layer by compressing said deposited fibres between said take-off roll and said air-permeable separating wall;
   - said exhaust duct extending at least into a zone of smallest clearance between the take-off roll and said air-permeable separating wall;
   - said chute containing a further wall; and
   - means for sealing the take-off roll with respect to said further wall.

2. The apparatus as defined in claim 1, wherein:
   - said means for sealing said take-off roll with respect to said further wall comprises a movable sealing element; and
   - means for mounting said movable sealing element in a position such that the pressure conditions prevailing in said chute augment the sealing action.

3. The apparatus as defined in claim 1, wherein:
   - said further wall is positioned opposite to said air-permeable separating wall; and
   - said means for sealing the take-off roll with respect to said further wall comprises a sealing element located between said further wall opposite said air-permeable separating wall and the take-off roll.

4. The apparatus as defined in claim 3, wherein:

said sealing element comprises a sheet-metal plate; and means for pivotably mounting said sheet-metal plate at said further wall and for contact with said take-off roll.

5. The apparatus as defined in claim 3, wherein:

said sealing element comprises a substantially cylindrical roll;

an extension plate provided for said further wall of said chute;

said cylindrical roll being arranged between said extension plate and said take-off roll and being pressed towards said chute.

6. The apparatus as defined in claim 3, further including:

means for movably mounting said take-off roll; and means for mounting said sealing element for movement together with the movement of said take-off roll.

* * * * *